US006984089B1

(12) United States Patent
Colvard

(10) Patent No.: US 6,984,089 B1
(45) Date of Patent: Jan. 10, 2006

(54) ADJUSTABLE-BATTER SIDE PLATE FOR SLIP-FORM PAVER

(75) Inventor: John Charles Colvard, Wilkesboro, NC (US)

(73) Assignee: Power Curbers, Inc., Salisbury, NC (US)

( * ) Notice: Subject to any disclaimer, the term of this patent is extended or adjusted under 35 U.S.C. 154(b) by 0 days.

(21) Appl. No.: 11/022,505

(22) Filed: Dec. 22, 2004

(51) Int. Cl.
*E01C 19/22* (2006.01)

(52) U.S. Cl. ..... 404/96; 404/119

(58) Field of Classification Search ..... 404/96, 404/105, 119
See application file for complete search history.

(56) References Cited

U.S. PATENT DOCUMENTS

| | | | | |
|---|---|---|---|---|
| 1,390,479 A | * | 9/1921 | Baker | 404/96 |
| 1,987,398 A | | 1/1935 | Gardiner | 94/44 |
| 2,962,947 A | | 12/1960 | MacDonald | 94/44 |
| 3,091,999 A | | 6/1963 | MacDonald | 94/44 |
| 3,175,478 A | | 3/1965 | Smith | 94/46 |
| 3,264,958 A | | 8/1966 | Babb et al. | 94/46 |
| 3,479,755 A | | 11/1969 | Schropp | 37/8 |
| 3,637,026 A | | 1/1972 | Snow | 172/4.5 |
| 3,680,451 A | | 8/1972 | Birtchet | 94/45 |
| 3,771,892 A | | 11/1973 | Munyon et al. | 404/84 |
| 3,936,211 A | * | 2/1976 | Miller et al. | 404/104 |
| 3,970,405 A | | 7/1976 | Swisher, Jr. et al. | 404/105 |
| 4,197,032 A | | 4/1980 | Miller | 404/98 |
| 4,360,293 A | | 11/1982 | Wade | 405/268 |
| 4,925,340 A | | 5/1990 | Heiser et al. | 404/75 |
| 4,948,292 A | | 8/1990 | Haven et al. | 404/84 |
| 5,044,820 A | | 9/1991 | Prang | 404/84 |
| 5,344,254 A | | 9/1994 | Sartain | 404/104 |
| 5,468,095 A | * | 11/1995 | Dawson | 404/118 |
| 5,590,977 A | | 1/1997 | Guntert et al. | 404/101 |
| 5,941,659 A | * | 8/1999 | Godbersen | 404/88 |
| 6,709,194 B1 | * | 3/2004 | Grimes | 404/96 |
| 6,715,957 B2 | | 4/2004 | Colvard et al. | 404/105 |

* cited by examiner

*Primary Examiner*—Gary S. Hartmann
(74) *Attorney, Agent, or Firm*—Kennedy Covington Lobdell & Hickman, LLP

(57) ABSTRACT

A side plate system for a slip-form paver apparatus includes a side plate in contact with a finishing pan, a vertically extendable and retractable tube assembly between the side plate and the frame of the paver apparatus, a set screw device for setting a batter angle of the side plate by pivoting the tube assembly and a thumbscrew device for maintaining a seal between the side plate and the finishing pan by closing any gap therebetween.

7 Claims, 10 Drawing Sheets

ADJUSTABLE-BATTER SIDE PLATE FOR SLIP-FORM PAVER

FIELD OF THE INVENTION

The present invention relates to a side plate for a slip-form paver apparatus, and more particularly to a side plate that is adjustable to introduce a side batter to the paved surface.

BACKGROUND OF THE INVENTION

Road construction apparatus designed to automate and standardize the process of paving new roads are well known in the art. One type of such construction apparatus is known as a slip-form paver, which is generally adapted to form a flowable paving material such as concrete continuously along the ground or other base surface, for example, to form a roadway. Diverse forms of such machines have been described in prior patents, representative examples of which may be found in U.S. Pat. Nos. 3,175,478; 3,264,958; 3,637,026; 3,771,892; 3,970,405; 4,197,032; 4,360,293; 4,925,340; 4,948,292; 5,044,820, 5,590,977 and 6,715,957.

Conventionally, it is commonplace for paving equipment of this type to support the machine frame on a plurality of drivable transport assemblies, such as so-called crawler track assemblies, adapted to facilitate steerable driving of the paving machine over substantially any ground surface along which a roadway or like surface is to be paved. The frame of the machine is equipped with various devices and mechanisms to perform various functions of the paving operation, including typically an auger or other suitable mechanism for distributing the paving material laterally across the front of the machine, followed by a vertically disposed plate or like structural member, commonly referred to as a strike-off plate, positioned with a lower edge thereof at a desired elevation with respect to the ground surface to be paved to control the amount of paving material passing thereunder and thereby to initially form the material generally as a slab of the desired thickness, and then followed by a substantially horizontally disposed undersurface, commonly referred to as a finishing pan or screed, for purposes of leveling and finishing the concrete material.

In basic operation, a continuous supply of concrete or other suitable paving material is deposited in front of the paving machine between its transport assemblies as the machine is driven over the intended path of the pavement surface, with the auger mechanism initially distributing the paving material laterally, after which the lower edge of the plate "strikes off" a rough slab form of a desired thickness of the concrete material which then is more precisely spread, leveled and finished by the vibration devices followed by the finishing pan.

Additionally, the paving machine must contain and shape the flow of concrete as it relates to the side of the roadway. This function is typically handled by a side plate somewhat similar in function to the finishing pan, but disposed perpendicularly at each side of the finishing pan. In machines where adjustments may be made to the height of the roadway, it is desirable to have a side plate that is vertically adjustable with respect to the finishing pan to accommodate different roadway heights, since the principal function of the side plate is to contain the flowing concrete within the vertical profile of the roadway.

This containment function necessitates a tight connection between the side plate and the finishing pan, because of the nature of concrete under vibrational forces. In a typical slip-form paver apparatus, the wet concrete is vibrated to a high degree in order to remove air pockets and to reduce the viscosity of the concrete. Concrete under vibration is highly non-viscous and flows to fill every space within the slip-form apparatus. Consequently, if there is a gap between the finishing pan and the side plate, following the vibration devices, concrete will flow through the gap, potentially exiting the slip-form apparatus. Such a condition is wasteful of time and resources and can damage the paver apparatus through the introduction of concrete into, for instance, the transport assembly.

If the side plate is perfectly perpendicular to the finishing pan, then maintaining a tight connection with the horizontal finishing pan is relatively easy. But in many paving applications, it is desirable to introduce a side batter, or angular offset of the side edges of the finished concrete. When a side batter is introduced in conventional systems, the function of adjusting the height of the side plate necessarily introduces a gap between the side plate and the finishing pan.

Accordingly, there is a need for a side plate system that permits the selection of a side batter while preventing the introduction of gaps in the slip-form area.

SUMMARY OF THE INVENTION

In accordance with the aforementioned needs, the present invention provides a side plate system for a slip-form paver apparatus that has a frame supported on a steerable transport assembly and a pavement forming assembly disposed on the frame for distributing a paving material along a ground surface and forming the paving material with a crown running generally parallel to the ground surface using a finishing pan in order to form a paved surface.

The side plate system includes a side plate that is disposed generally perpendicular to and in contact with the finishing pan and that has a forming surface on an inward side of the side plate for slip-forming an essentially vertical side of the paved surface. The system further includes a vertically directed extendable and retractable tube assembly connected between the side plate and the pavement forming assembly. The side plate system also includes a set screw arrangement operatively associated with the tube assembly for setting a batter angle of the side plate by pivoting the disposition of the tube assembly relative to the finishing pan.

In a further feature of the present invention, the side plate is movable through a range of vertical motion for accommodating a desired height of the paved surface from the ground surface, without introducing a gap between the side plate and the finishing pan. The side plate is configured to remain substantially in contact with the finishing pan throughout the range of vertical motion, even when the batter is set at a nonzero angle.

The side plate system also includes a piston for supporting the side plate. The piston is connected at one end to the frame or to the pavement-forming assembly and at the other end to the side plate, and in order to accommodate the range of batter angles, the piston is preferably pivotably mounted at each end.

In another feature of the present invention, the side plate comprises mating plate segments, each of which is similarly supported and configured for at least partially independent operation and movement.

Optionally, the side plate may be configured to swing in the outward direction, independently from the batter adjustment operation, to accommodate access to the area in which the surface is to be paved (i.e., under and in front of the finishing pan), for cleaning or maintenance.

The batter angle may be set within a range of between about 0° and 5° from the perpendicular, or perhaps a greater angle depending upon the precise configuration and arrangement of the tubes, without departing from the scope of the invention.

BRIEF DESCRIPTION OF THE DRAWINGS

Further features, embodiments, and advantages of the present invention will become apparent from the following detailed description with reference to the drawings, wherein.

DETAILED DESCRIPTION OF THE PREFERRED EMBODIMENTS

Figure 1:
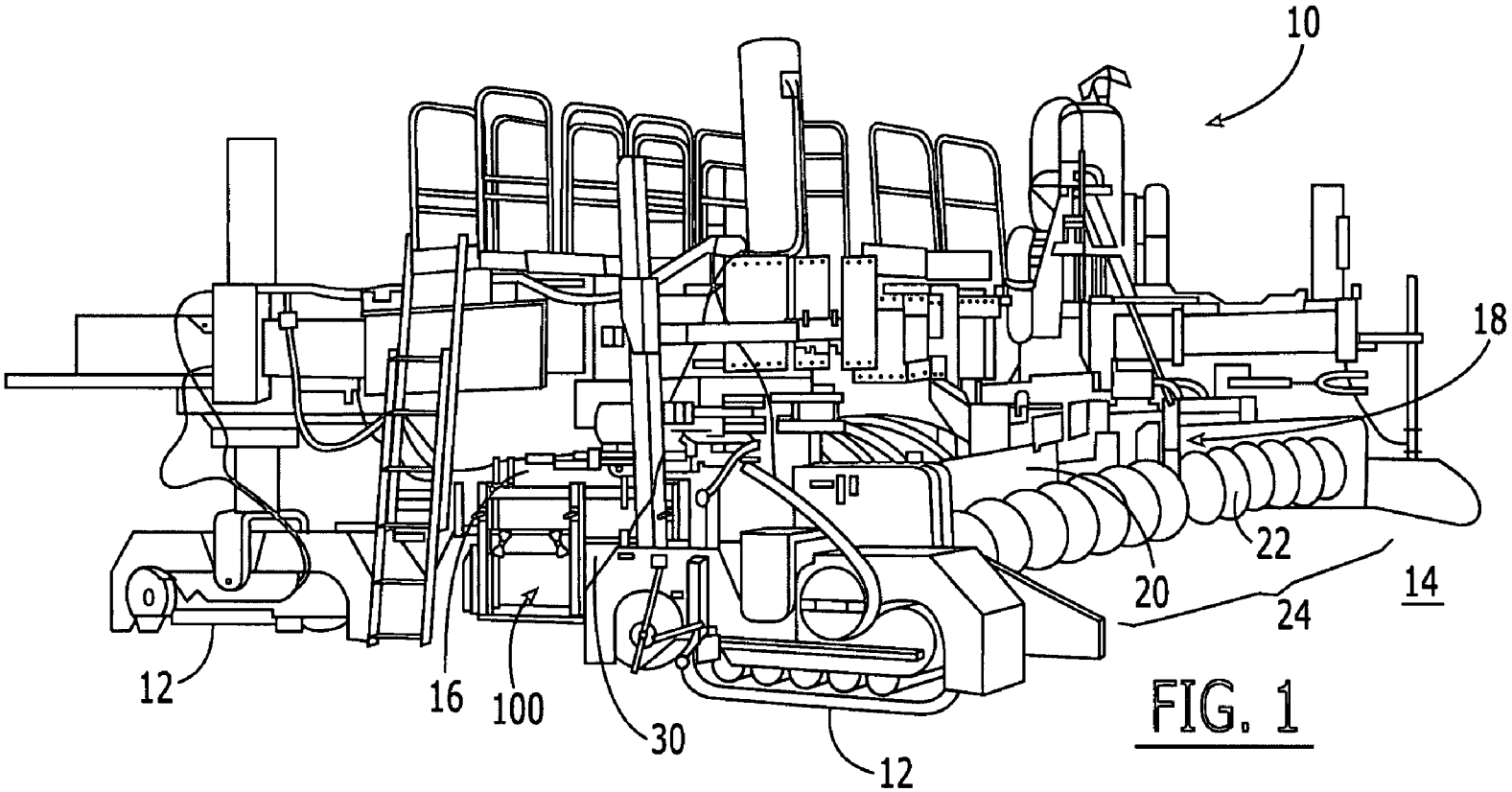
FIG. 1 is a general perspective view of a slip-form paver apparatus with an adjustable-batter side plate system according to a preferred embodiment of the present invention installed.

Referring now to the drawings, FIG. 1 illustrates a slip-form paver apparatus 10 of the general type to which the present invention is directed, as a depiction of the environment in which the side plate system of the present invention is embodied. A set of crawlers 12 drives the paver 10 along a roadbed 14 and support a frame 16 upon which is mounted a pavement forming assembly 18 for distributing a paving material along the roadbed 14 using a strike-off plate 20 in order to form a paved surface. In operation, a quantity of flowable paving material (not shown) such as concrete is deposited in the region forwardly of the frame 16 where a set of helical spreaders 22 are situated. The spreaders 22 distribute the paving material in rough uniformity across the widthwise extent of the paving region 24.

Adjacent and behind the spreaders 22 are the strike-off plate 20 which has a lower edge generally parallel with the roadbed 14, and laterally extended side plates 30 which are generally perpendicular to both the roadbed 14 and the strike-off plate 20, so as to define the rough profile of the general shape of a road (i.e., having a roughly rectangular lateral cross-section). A set of mechanical agitators (not shown) follow the strike-off plate 20 to be disposed atop and/or within the paving material to impart an agitating force to the paving material. This agitating force alters the physical dynamics of the paving material, making it more liquid, which enables the paving material flow to be formed into the desired road profile. A finishing pan 25 (FIGS. 2–3), also referred to as a screed, is supported by the frame 16 following the agitators and presents a substantially flat undersurface in facing spaced parallel relation to the road bed 14 to impart a correspondingly flat (often with a preferably slight crown) finished upper surface to the agitated paving material. The lateral sides of the paving material are contained in the region of the finishing pan 25 and are imparted with an essentially vertical finished surface (sometimes preferably with a slight batter angle) by side plate systems 100 disposed vertically in substantially tight contact with the opposite lateral ends of the finishing pan 25 at the opposite lateral sides of the paver apparatus.

As noted previously, a number of considerations determine the precise shape of the cross-section of the road being paved. Some of these considerations have been described elsewhere, such as the ability to crown or slant the road being paved. The present invention, however, is directed to the configuration of the sides of the road, and more particularly to the batter angle of that side. While various adjustments are known in the side plate systems of conventional slip-form paving apparatus and, in particular, it has heretofore been conventionally possible to adjust the batter angle when slip-form paving of a road, the known adjustability of the batter angle inherently results in a loss of sealing the batter plate thereby creating undesirable gaps in the form of the paver apparatus which interferes with the desired formation of the road. By contrast, the present invention provides an adjustable-batter side plate system which enables vertical adjustability of the side plate system as well as adjustability of the batter angle while continuously maintaining a secure seal with the side plate throughout the entire range of vertical and angular adjustments so that gaps are not created between the side plate and the finishing pan 25 so as not to interfere with the general operation of the paver apparatus.

Figure 2:
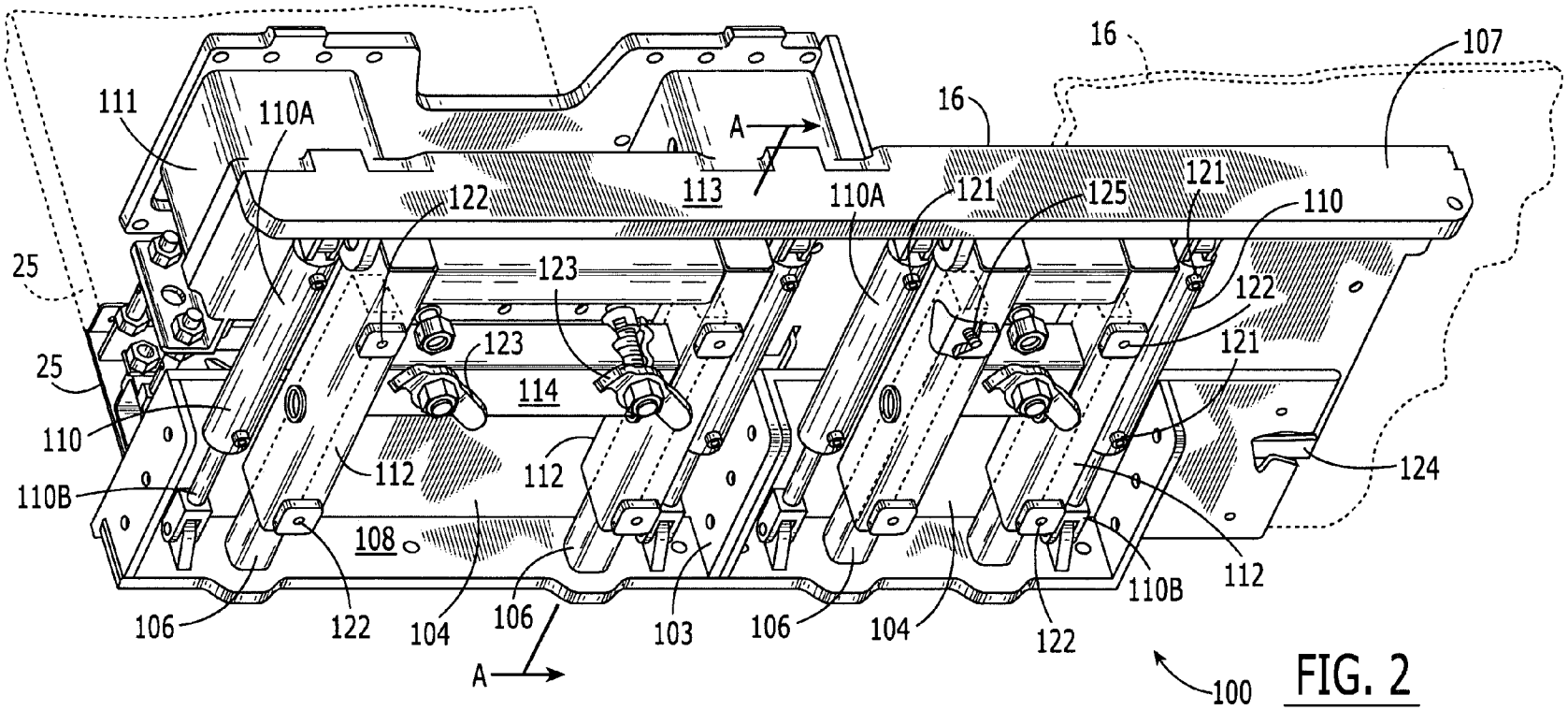
FIG. 2 is a more detailed perspective view of a portion of the slip-form paver apparatus as in FIG. 1, depicting the outwardly-facing portions of the side plate system according to the present invention.
Figure 3:
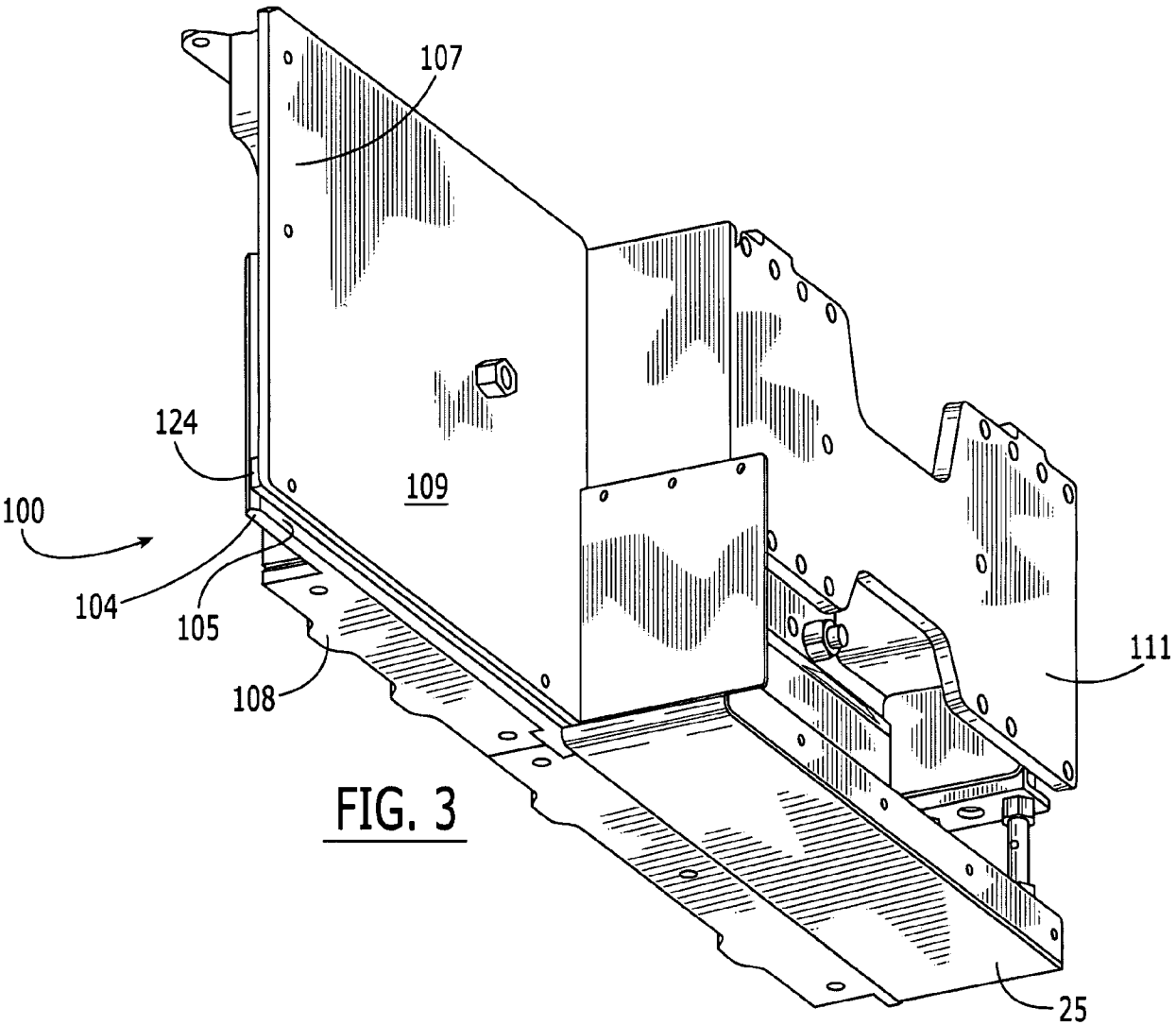
FIG. 3 is another detailed perspective view of a portion of the slip-form paver apparatus as in FIG. 2, depicting the inwardly-facing portions of the side plate system according to the present invention.

The adjustable-batter side plate system of the present invention 100 is shown in detailed perspective views in FIGS. 2 and 3. Principally the side plate system includes at least one side plate 104 supported vertically from the frame 16 adjacent to and in engagement with the finishing pan 25 at an angle A (FIGS. 7A and 7B) that can be adjusted within a limited range between substantially perpendicular and a small acute angle from perpendicular, as will be described in greater detail below.

Figure 2A:
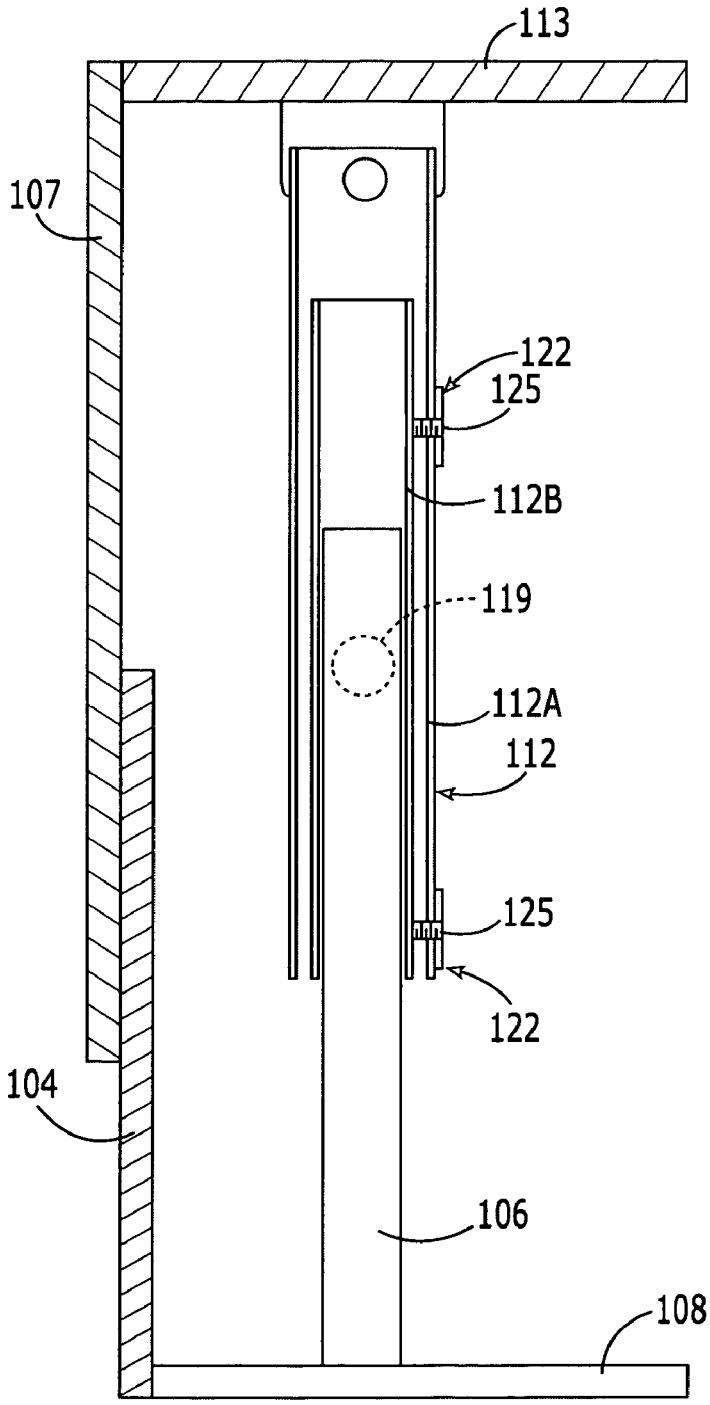
FIG. 2A is a vertical cross-sectional view taken through one of the tube assemblies of FIG. 2 along line A—A thereof.
Figure 4:
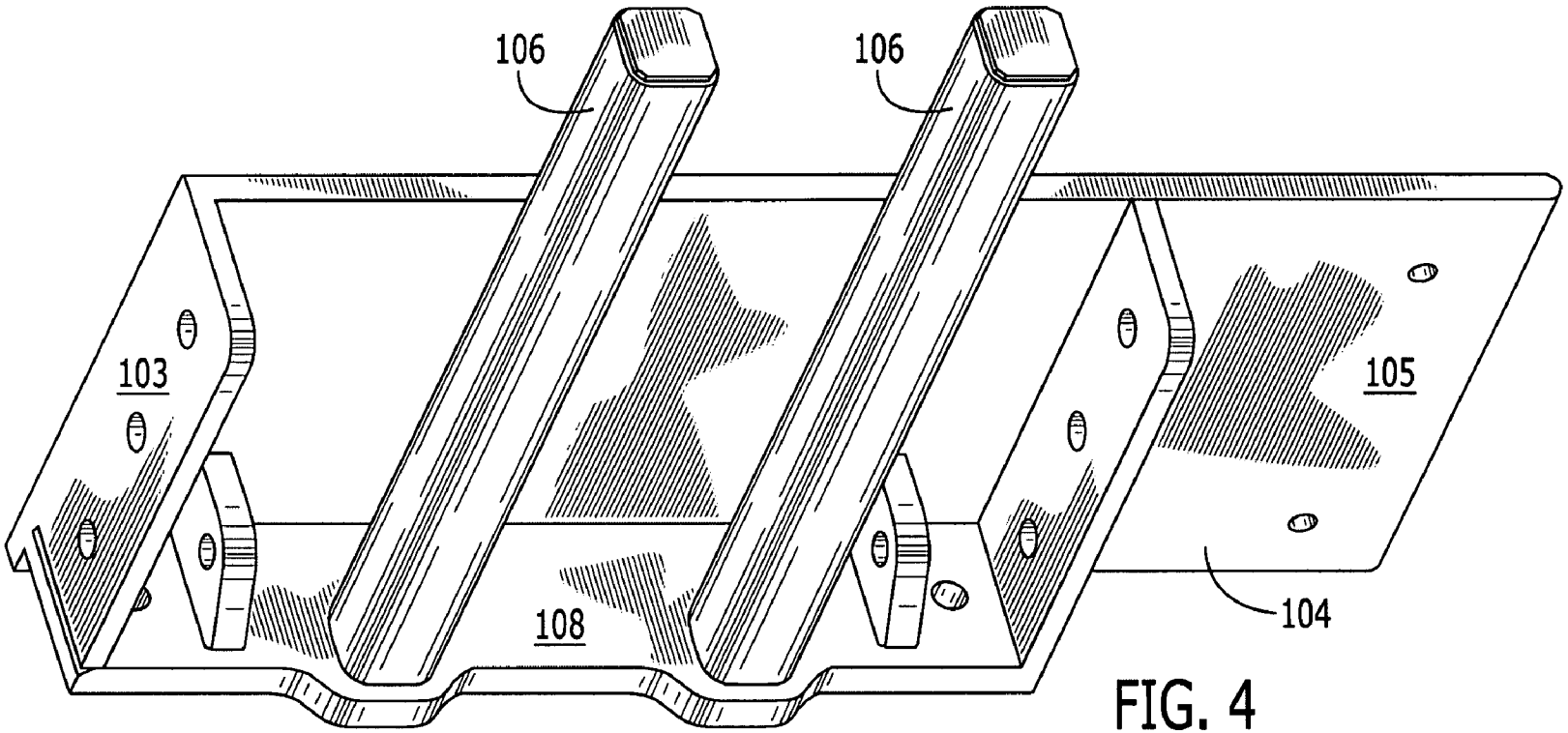
FIG. 4 is a detailed perspective view of a side plate according to the present invention.
Figure 5:
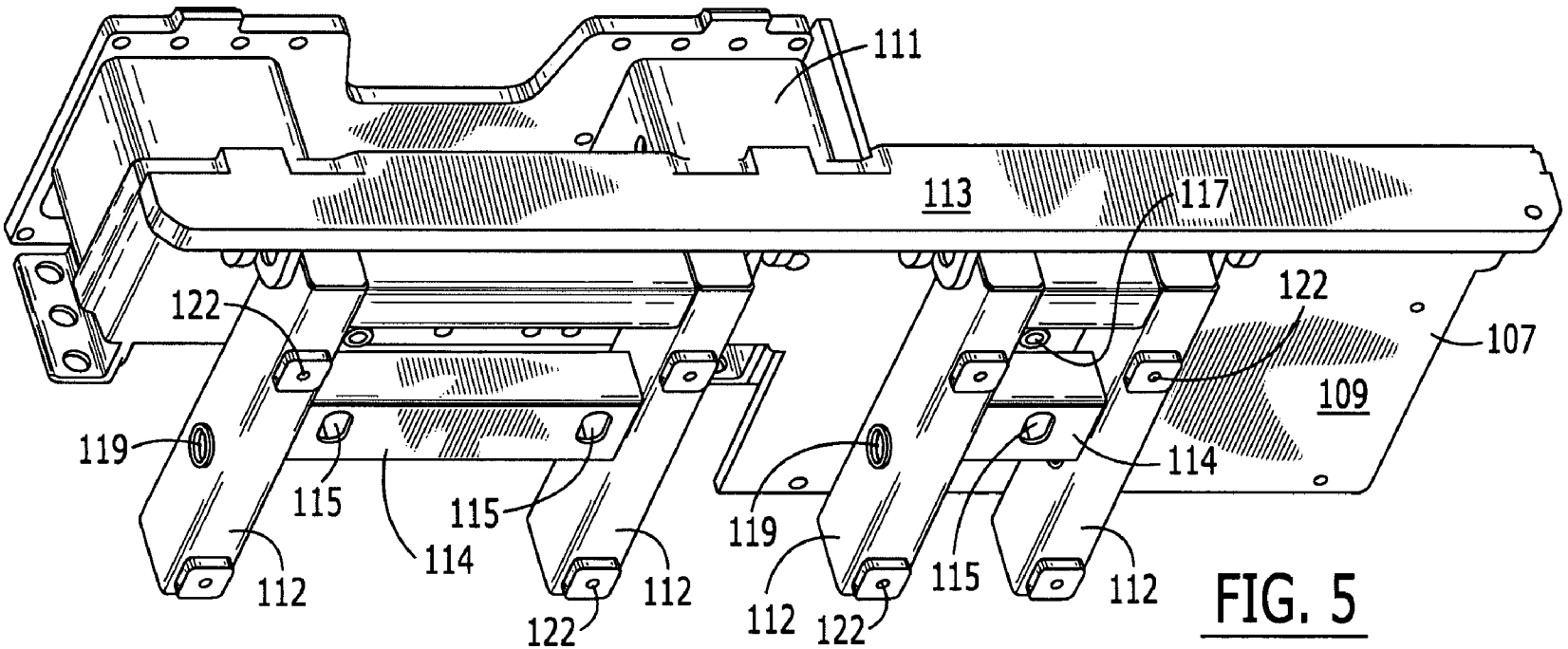
FIG. 5 is a detailed perspective view of a frame portion of the paver apparatus to which the side plate of FIG. 4 attaches.

One side plate 104 itself is shown in FIG. 4 and comprises a substantially flat planar working body 105 which faces inwardly toward the finishing pan 25 and a set of inner tubes 106 located on the outside (non-paving side) of the side plate body 105, and fixed in upstanding disposition on a flange 108 that extends outwardly from the lower edge of the working body 105 of the side plate 104. The side plate 104 is supported from the frame 16 by assembly with a mating frame plate 107, depicted separately in FIG. 5, which forms a portion of the frame 16 at each opposite lateral side of the paver apparatus 10. The frame plate 107 comprises a substantially flat planar main body 109 disposed substantially vertically, with a mounting block assembly 111 fixed to the inwardly facing side of the main body 109. The frame plates 107 are arranged in opposed facing relation to one another at the opposite sides of the paver apparatus 10 to support the finishing pan 25 extending laterally therebetween across the frame 16 by mounting of the opposite ends of the finishing pan 25 with the respective block assemblies 111. The frame plate 107 has a set of outer tube assemblies 112 affixed in depending relation to the underside of an upper flange 113 extending outwardly from the main body 109, the outer tube assemblies 112 being spaced correspondingly to the inner tubes 106 of the side plate 104. As best seen in FIG. 2A, each of the outer tube assemblies 112 supported from the frame plate 107 comprise a main outer tube 112A of a hollow substantially square cross-section pivotably supported at its uppermost end on the underside of the upper flange 113 and a secondary outer tube 112B of a similarly hollow but smaller square cross-section extending interiorly within the main outer tube 112A and secured thereto by trunnions 119 midway along the length of the secondary outer tube 112B to permit a limited degree of pivotal movement relative to the main outer tube 112A. Set screw devices 122 are secured on each main outer tube 112A at a spacing above and below each such trunnion 119.

As shown in FIG. 2, the side plate system 100 may comprise two, or possibly more, individual side plates 104 connected in endwise abutment via abutting attachment flanges 103 with their respective working bodies 105 coplanar to form a continuous uninterrupted inwardly-facing pavement-working surface. In such an embodiment, each side plate 104 is of substantially corresponding construction, each with a respective set of upstanding inner tubes 106. Correspondingly, the frame plate 107 has mounted thereto a like number of sets of the outer tube assemblies 112. The respective outer tube assemblies 112 of each set are connected integrally with one another by a laterally-extending tube 114 formed with apertures 115 aligned with threaded bores 117 located adjacently in the frame plate 107.

Figure 6A:
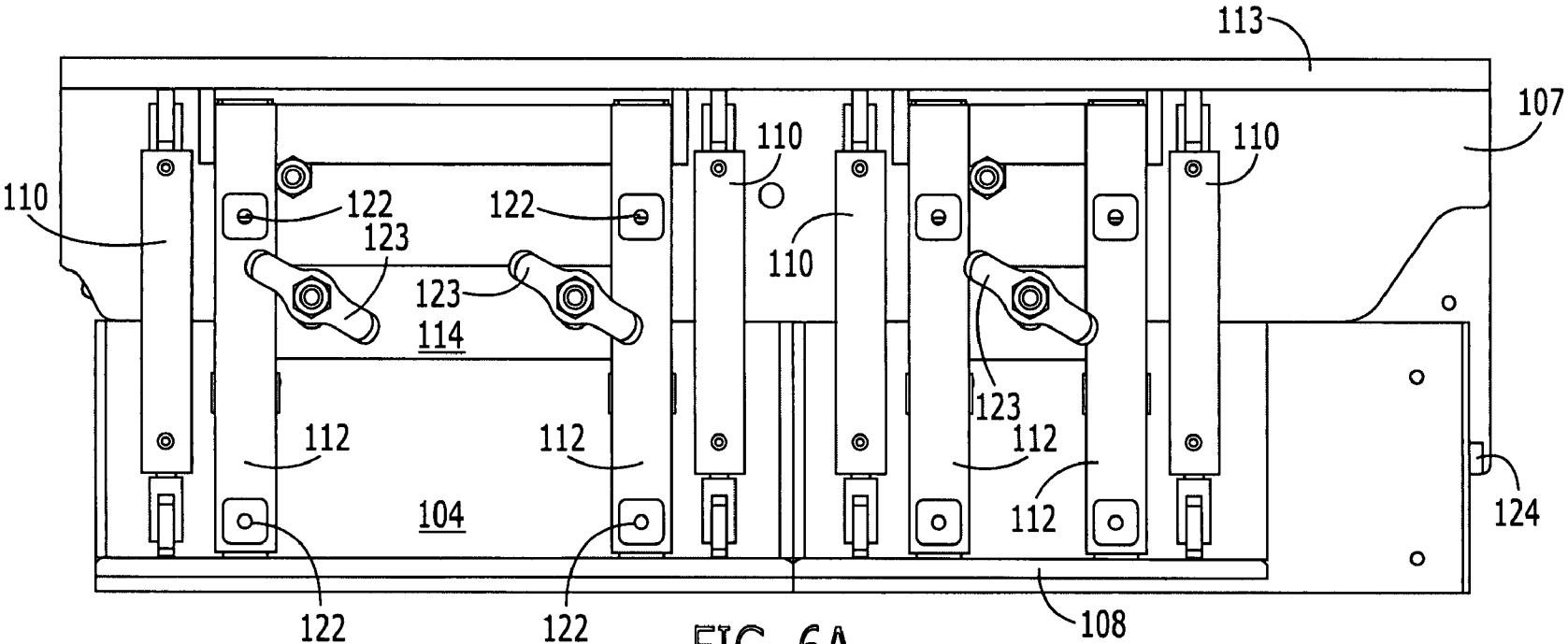
FIGS. 6A and 6B are side elevational views of the side plate system of FIGS. 2–5 according to the present invention in retracted and extended positions.
Figure 6B:
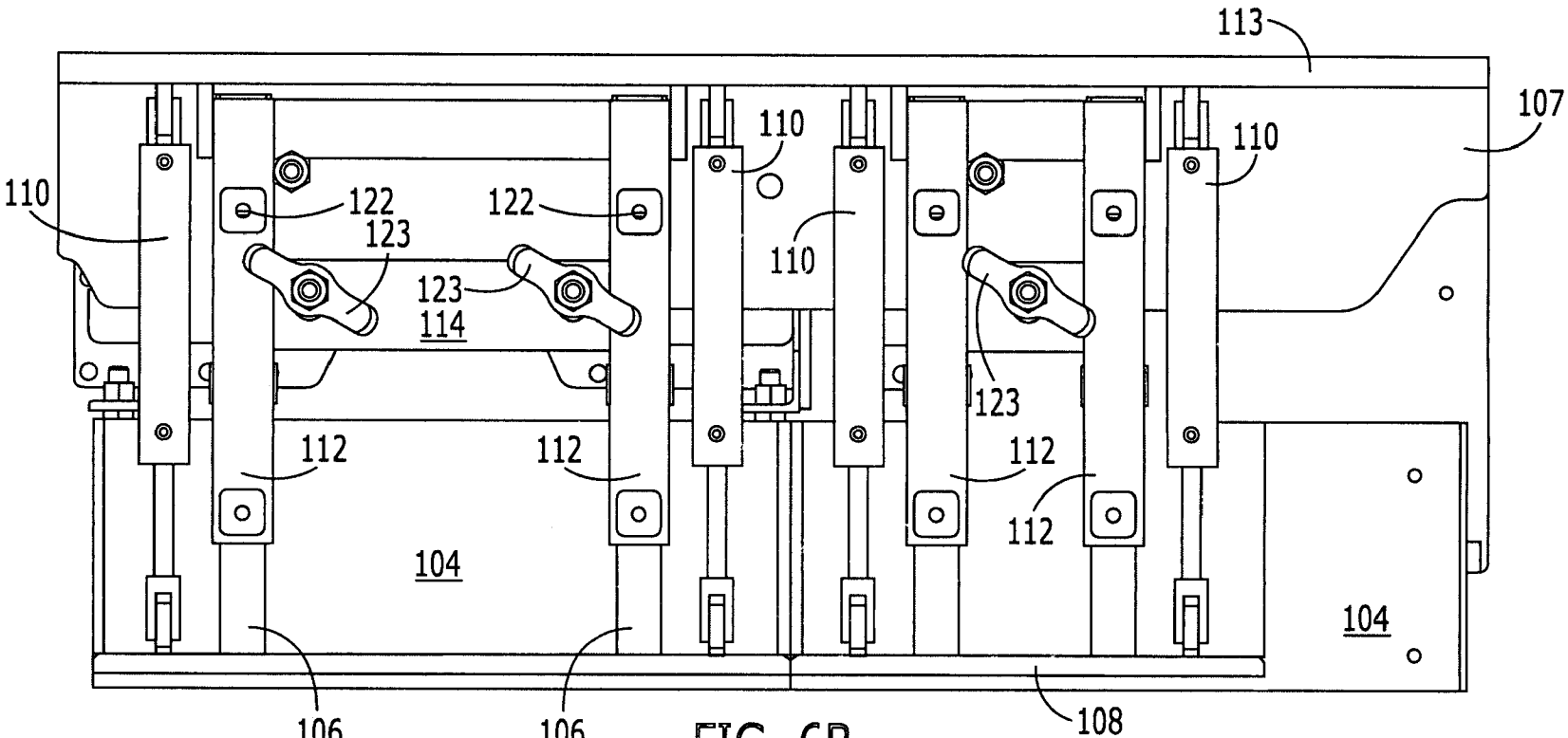

As best seen in FIG. 2A, the side plates 104 are mounted as a unit to the frame plate 107 by insertion of the inner tubes 106 into the secondary outer tubes 112B. The side plates 104 are supported in assembly with the frame plate 107 by a set of piston-and-cylinder assemblies 110, which extend vertically between, and have their opposite ends pivotably mounted to, the flange 113 of the frame plate 107 and the flange 108 of the side plates 104. The piston-and-cylinder assemblies 110 are connected into the hydraulic circuitry of the paver apparatus 110 by hydraulic connections 121 at the opposite ends of the cylinder portions 110A of the piston-and-cylinder assemblies 110 (the hydraulic flow lines being omitted from the illustrations for purposes of clarity), by which the piston portions 110B can be selectively extended and retracted to set the vertical disposition of the side plates 104 relative to the finishing pan 25, fully retracted and fully extended dispositions of the piston-and-cylinder assemblies 110 and the side plates 104 being depicted comparatively in FIGS. 6A and 6B. The side plates 104 are secured and held in sealing abutment against the outward surface of the frame plate 107 by the tightening of thumbscrews 123 extending through the apertures 115 in the connecting members 114 and threadedly engaged into the bores 117 in the side plate 107.

Figure 7A:
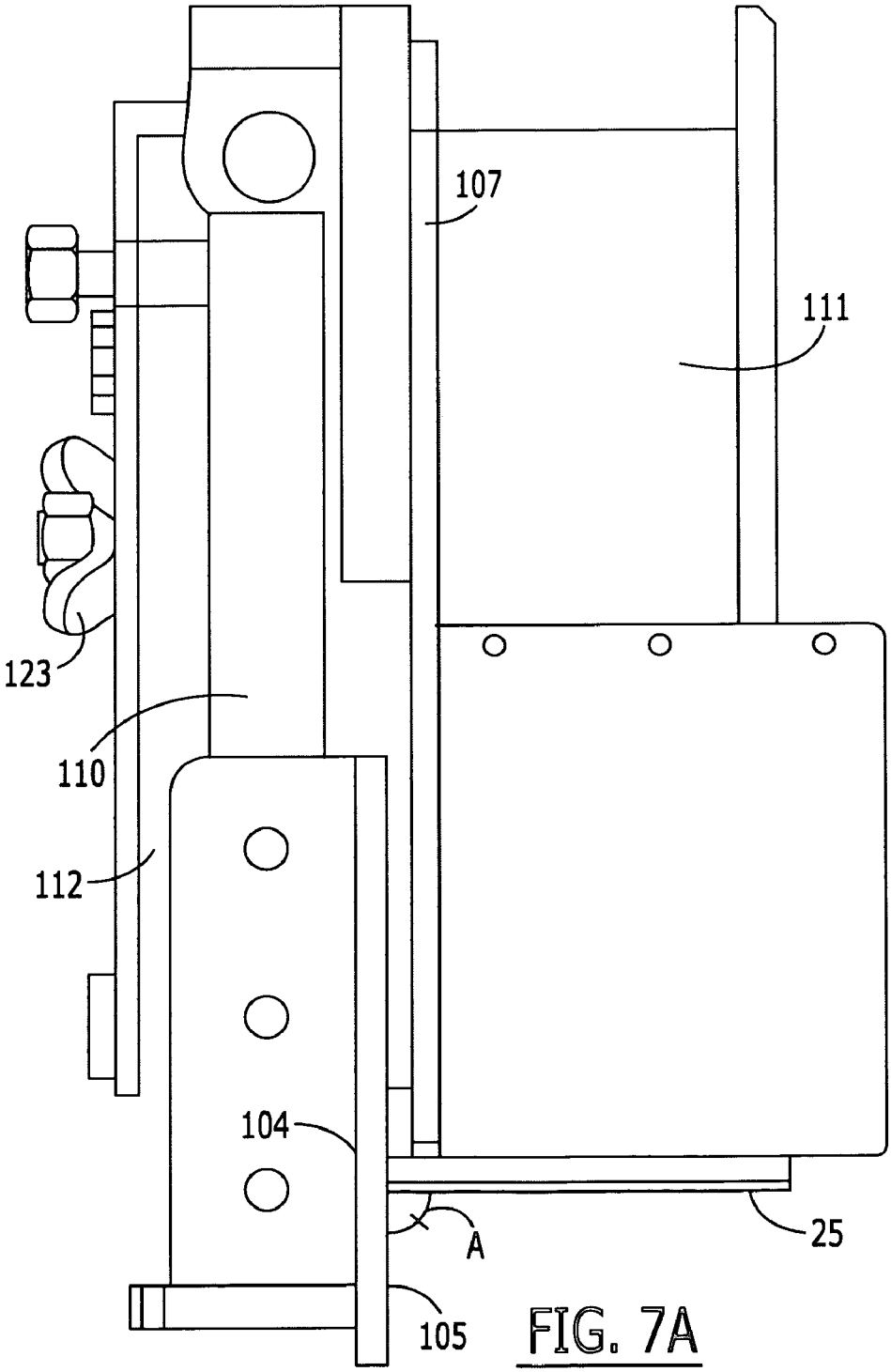
FIGS. 7A and 7B are end elevational views of the side plate system of FIGS. 2–5 according to the present invention in non-pivoted (zero batter angle) and pivoted (inclined batter angle) positions.
Figure 7B:
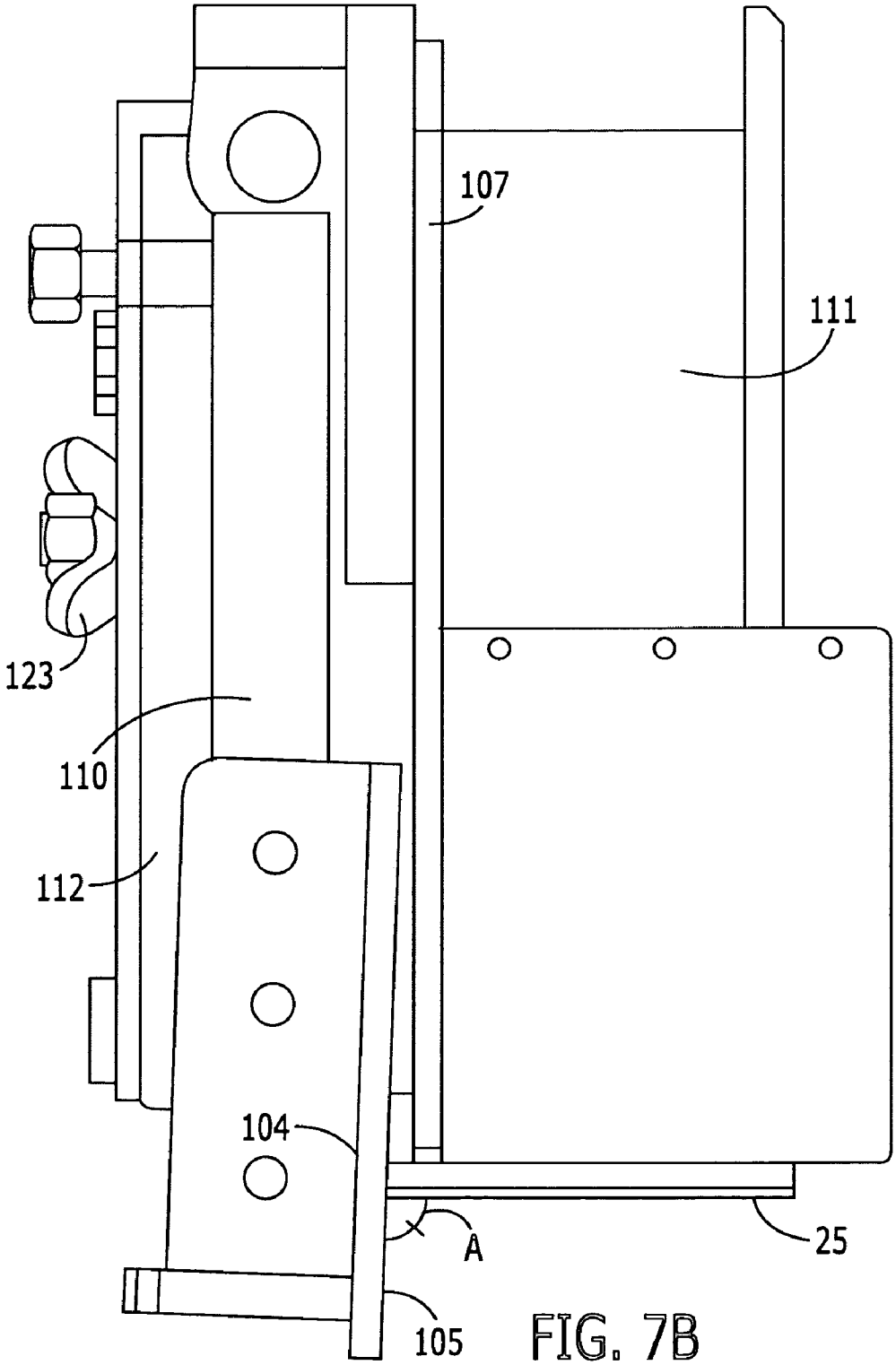

In accordance with the present invention, the set screw devices 122 facilitate the selective setting of the angular relationship between the side plates 104 and the finishing pan 25 in the following manner. Each set screw device 122 threadedly supports a set screw 125 to be selectively extended into or retracted from the hollow interior of the respective main outer tube 112A and thereby into contact with the respective secondary outer tube 112B supported therein. By the selective threaded positioning of the upper and lower set screws 125 of each outer tube assembly 112, the secondary outer tube 112B therein is selectively positioned pivotably about the respective trunnions 119. The hollow interior of the main outer tubes 112A is sufficiently larger in cross-sectional profile than the secondary outer tubes 112B, thereby providing for a pivotal range of motion of the secondary outer tubes 112B within the main outer tubes 112A. Thus, the selectively adjustment of the set screws 122 enables the selective adjustment of the angular orientation of the side plates 104 relative to the frame plate 107 (i.e. the batter angle) from a precisely parallel relationship (a so-called zero angle position) through a limited range of angular motion relative to the frame plate 107, preferably up to approximately five degrees to set a selected batter angle. FIGS. 7A and 7B comparatively depict the side plate system in zero angle and pivoted batter angle positions, respectively. Subsequent to any such adjustment of the set screws 122, the thumb screws 123 are securely tightened to insure that any gap created between the inwardly-facing working surface of the side plates 104 and the finishing pan 25 is closed and a secure seal is created therebetween. To assist in preventing the formation of any such gap, a sealing bar 124 is secured to the outward surface of the frame plate 107 up to the finishing pan 25, for bearing engagement of the side plates 104 against the sealing bar 124.

Thus, as will be understood by persons of skill in the art, the side plate system 100 of the present invention uniquely accommodates both elevational and angular positioning movement of the side plates 104 relatively to the finishing pan 25, while providing for the secure sealing of the inwardly-facing working surface of the side plates 104 against the finishing pan 25 to close any gap thereby created. Thus, in contrast to slip-form paver apparatus of the prior art, the side plate system of the present invention enables a range of non-perpendicular batter angles to be reliably set while avoiding waste of the paving material and potential damage to the paver apparatus.

The side plate system of the present invention additionally provides for ready movement of the entire side plate unit for direct access to the area of the finishing pan beneath the paver apparatus, e.g., for purposes of repair, cleaning, maintenance, or similar purpose. Specifically, upon disengagement of the thumb screws 123 the pivoted mountings of the outer tube assemblies 112 and the piston-and-cylinder assemblies 110 to the frame plate 107, enables the entire side plate unit to be pivoted upwardly to fully expose the finishing pan 25. Further, the provision of the side plate system 100 with two separate side plate members 104 disposed in endwise abutting relation to each other permits each of the side plate members 104 to be pivoted outwardly independently as desired. While those skilled in the art of paving will recognize that the batter angle of both side plates 104 will preferably be set at the same angle, a split arrangement of the side plates and independent operation thereof allow the side plates to swing in the outward direction to allow access to the underside of the paver assembly and to the paved surface. This is of particular importance when starting a new day of work, when the section of the road to be paved abuts the previous day's end of work. A swing-out arrangement such as is depicted in FIG. 2 allows, for example, the rear side plate 104 to be swung out to accommodate the finished surface, while keeping the front side plate 104 in good abutment with the frame plate 107. However, the construction of the side plates 104 is such that they may be locked unitarily into place for movement together by inserting a pin, bolt, or screw (not shown) through one or more holes in the abutment flanges 103.

In view of the aforesaid written description of the present invention, it will be readily understood by those persons skilled in the art that the present invention is susceptible of broad utility and application. Many embodiments and adaptations of the present invention other than those herein described, as well as many variations, modifications, and equivalent arrangements, will be apparent from or reasonably suggested by the present invention and the foregoing description thereof, without departing from the substance or scope of the present invention. Accordingly, while the present invention has been described herein in detail in relation to preferred embodiments, it is to be understood that this disclosure is only illustrative and exemplary of the present invention and is made merely for purposes of providing a full and enabling disclosure of the invention. The foregoing disclosure is not intended nor is to be construed to limit the present invention or otherwise to exclude any such other embodiments, adaptations, variations, modifications and equivalent arrangements, the present invention being limited only by the claims appended hereto and the equivalents thereof.

What is claimed is:

1. In a slip-form paver apparatus comprising a frame supported on a steerable transport assembly and a pavement forming assembly having an essentially horizontal finishing pan disposed on the frame for distributing and forming a paving material along a ground surface, a side plate system comprising:

a side plate disposed generally vertically in perpendicular relation to and in contact with the finishing pan and having a forming surface on an inward side thereof for slip-forming a substantially vertical side of the paved surface;

a vertically-directed extendable and retractible tube assembly connected between the side plate and the pavement forming assembly for adjusting a vertical disposition of the side plate;

a set screw device for adjusting an angular disposition of the tube assembly within a range of batter angles of the side plate relative to the finishing pan; and a thumbscrew device connected between the side plate and the frame for closing any gap created between the side plate and the finishing pan and thereby to form a seal therebetween when the side plate is set at the non-perpendicular batter angle.

2. A side plate system according to claim 1, wherein the side plate is movable through a range of vertical motion for selectively accommodating a desired height of the finishing pan from the ground surface.

3. A side plate system according to claim 2, wherein the side plate system is arranged to maintain the side plate substantially in contact with the finishing pan through the range of vertical motion.

4. A side plate system according to claim 2, further comprising a piston device for supporting the side plate, the piston being pivotably connected between the frame and the side plate for adjusting the vertical height of the side plate.

5. A side plate system according to claim 1, wherein the side plate comprises mating side plate portions.

6. A side plate system according to claim 1, wherein the side plate system is arranged for selective movement of the side plate swinging in an outward direction to accommodate access to the finishing pan.

7. A side plate system according to claim 1, wherein the batter angle is set within a range between about 0° and about 5° relative to the finishing pan.

* * * * *